US010964269B2

(12) United States Patent
Kim et al.

(10) Patent No.: US 10,964,269 B2
(45) Date of Patent: Mar. 30, 2021

(54) DISPLAY DEVICE

(71) Applicant: Samsung Display Co., Ltd., Yongin-si (KR)

(72) Inventors: Il Joo Kim, Yongin-si (KR); Gyung Soon Park, Yongin-si (KR); Jun Ki Jeong, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/274,095

(22) Filed: Feb. 12, 2019

(65) Prior Publication Data

US 2019/0251908 A1 Aug. 15, 2019

(30) Foreign Application Priority Data

Feb. 12, 2018 (KR) ..... 10-2018-0016964

(51) Int. Cl.
*G09G 3/3266* (2016.01)
*G09G 3/3275* (2016.01)
*G09G 3/3233* (2016.01)

(52) U.S. Cl.
CPC ..... *G09G 3/3266* (2013.01); *G09G 3/3233* (2013.01); *G09G 3/3275* (2013.01); *G09G 2310/0297* (2013.01); *G09G 2310/08* (2013.01)

(58) Field of Classification Search
None
See application file for complete search history.

(56) References Cited

U.S. PATENT DOCUMENTS 5,408,252 A * 4/1995 Oki ..... G09G 3/3648 345/205
6,552,707 B1 * 4/2003 Fujiyoshi ..... G09G 3/3648 345/100
9,542,874 B2 1/2017 Park et al.
2004/0239605 A1 * 12/2004 Wang ..... G09G 3/3614 345/96
2006/0164350 A1 * 7/2006 Kim ..... G09G 3/3614 345/87
2011/0042676 A1 * 2/2011 Ren ..... H01L 27/124 257/59
2018/0233097 A1 * 8/2018 Konoshita ..... G09G 3/3677
2018/0357983 A1 * 12/2018 Yumoto ..... G09G 3/32

* cited by examiner

*Primary Examiner* — Dorothy Harris
(74) *Attorney, Agent, or Firm* — Lewis Roca Rothgerber Christie LLP

(57) ABSTRACT

A display device including: a plurality of pixel rows, each of the pixel rows including a plurality of first and second pixels arranged along a first direction; a plurality of first bus wires extending along the first direction and being connected to the first pixels, each of the first bus wires being at one side of a corresponding pixel row from among the pixel rows; and a plurality of second bus wires extending along the first direction and being connected to the second pixels, each of the second bus wires being at one side of a corresponding pixel row from among the pixel rows.

15 Claims, 7 Drawing Sheets

DISPLAY DEVICE

CROSS-REFERENCE TO RELATED APPLICATION

This application claims priority to and the benefit of Korean Patent Application No. 10-2018-0016964, filed on Feb. 12, 2018 in the Korean Intellectual Property Office, the entire disclosure of which is incorporated by reference herein.

BACKGROUND

1. Field

Aspects of embodiments of the present disclosure relate to a display device.

2. Description of the Related Art

Various display devices are being developed. Such display devices include a liquid crystal display device, a plasma display device, an organic light emitting display device, etc.

Such display devices include a display panel and drivers for driving the display panel. The display panel includes pixels connected to scan lines and data lines, and the pixels are arranged in a matrix. Each of the pixels receives a data voltage from a corresponding data line in response to a scan signal from a corresponding scan line and displays an image (e.g., a portion of an image) by representing (e.g., displaying or emitting) a gray level corresponding to the supplied data voltage.

SUMMARY

Embodiments of the present disclosure provide a display device having improved display quality.

According to an aspect of the present disclosure, a display device includes: a plurality of pixel rows, each of the pixel rows including a plurality of first and second pixels arranged along a first direction; a plurality of first bus wires extending along the first direction and being connected to the first pixels, each of the first bus wires being at one side of a corresponding pixel row from among the pixel rows; and a plurality of second bus wires extending along the first direction and being connected to the second pixels, each of the second bus wires being at one side of a corresponding pixel row from among the pixel rows.

The first bus wires may be configured to supply first scan signals to the first pixels, and the second bus wires may be configured to supply second scan signals to the second pixels.

The first scan signals may overlap with the second scan signals during a period.

The display device of may further include a plurality of first bridge patterns connected to the first bus wires and a plurality of second bridge patterns connected to the second bus wires.

Each of the first pixels and each of the second pixels may include a plurality of sub-pixels.

Adjacent ones of the sub-pixels in each of the first pixels may be configured to receive the first scan signals through one of the first bridge patterns.

Adjacent ones of the sub-pixels in each of the second pixels may be configured to receive the second scan signals through one of the second bridge patterns.

Each of the first bridge patterns and each of the second bridge patterns may be located between adjacent ones of the sub-pixels.

The first pixels may be configured to receive the first scan signals through the first bridge patterns, and the second pixels may be configured to receive the second scan signals through the second bridge patterns.

A jth first bus wire from among the first bus wires and a jth second bus wire from among the second bus wires may be between a jth pixel row and a (j+1)th pixel row from among the pixel rows, and j is a natural number greater than or equal to 2.

The jth first bus wire may be between the jth second bus wire and the jth pixel column.

The first pixels in the jth pixel row may be connected to a first bridge pattern connected to a (j−1)th first bus wire from among the first bus wires and to a first bridge pattern connected to the jth first bus wire.

The second pixels in the jth pixel row may be connected to a second bridge pattern connected to a (j−1)th second bus wire from among the second bus wires and a second bridge pattern connected to the jth second bus wire.

The first pixels and the second pixels may be alternately arranged in one of the pixel rows.

The first pixels may be arranged along a second direction, and the second pixels may be arranged along the second direction.

BRIEF DESCRIPTION OF THE DRAWINGS

Example embodiments of the present disclosure will now be described more fully hereinafter with reference to the accompanying drawings; however, the present disclosure may be embodied in different forms and should not be construed as being limited to the example embodiments set forth herein. Rather, these embodiments are provided so that this disclosure will be thorough and complete, and will fully convey the scope of the present disclosure to those skilled in the art.

In the figures, dimensions may be exaggerated for clarity of illustration and like reference numerals refer to like elements throughout.

DETAILED DESCRIPTION

Figure 1A:
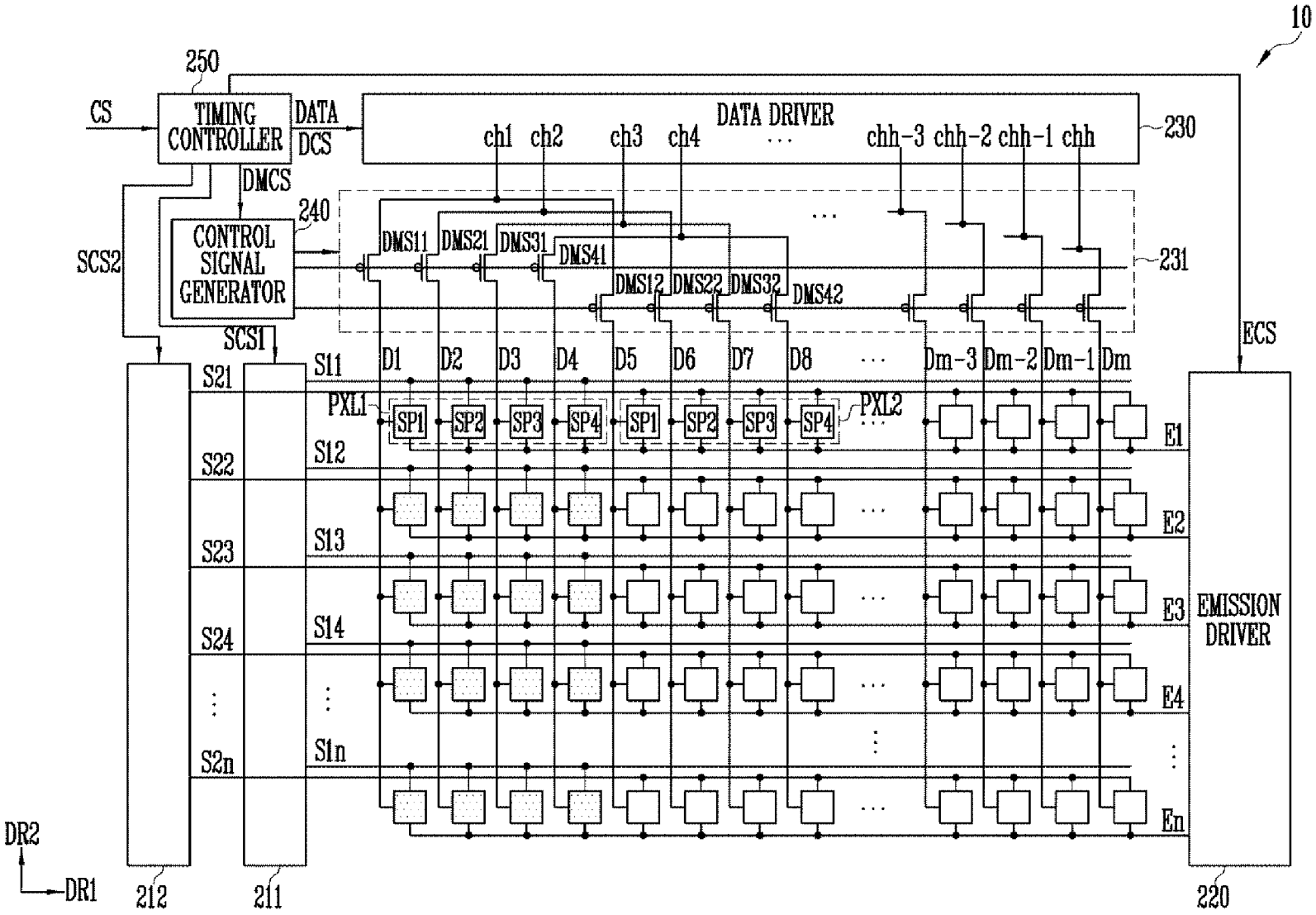
FIG. 1A is a diagram illustrating a configuration of a display device according to an embodiment of the present disclosure.

Hereinafter, embodiments will be described in greater detail with reference to the accompanying drawings.

Aspects and features of the present disclosure, and the way of attaining them, will become apparent with reference to embodiments described below in conjunction with the accompanying drawings. However, the present disclosure is not limited to these embodiments and may be implemented in different forms. These embodiments are provided for illustrative purposes and for full understanding of the scope of the present disclosure by those skilled in the art.

Throughout the specification, when an element is referred to as being "on," "connected," or "coupled" to another element, it can be directly on, connected, or coupled to the other element or be indirectly on, connected, or coupled to the other element with one or more intervening elements interposed therebetween.

As used herein, the term "and/or" includes any and all combinations of one or more of the associated listed items. Further, the use of "may" when describing embodiments of the present invention relates to "one or more embodiments of the present invention." Expressions, such as "at least one of," when preceding a list of elements, modify the entire list of elements and do not modify the individual elements of the list. Also, the term "exemplary" is intended to refer to an example or illustration. As used herein, the terms "use," "using," and "used" may be considered synonymous with the terms "utilize," "utilizing," and "utilized," respectively.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" or "over" the other elements or features. Thus, the term "below" may encompass both an orientation of above and below. The device may be otherwise oriented (rotated 90 degrees or at other orientations), and the spatially relative descriptors used herein should be interpreted accordingly.

The data driver, scan drivers, control signal generator, timing controller, emission driver, and/or any other relevant devices or components according to embodiments of the present invention described herein may be implemented utilizing any suitable hardware, firmware (e.g., an application-specific integrated circuit), software, and/or a suitable combination of software, firmware, and hardware. For example, the various components of the data driver, scan drivers, control signal generator, timing controller, and/or emission driver may be formed on one integrated circuit (IC) chip or on separate IC chips. Further, the various components of the data driver, scan drivers, control signal generator, timing controller, and/or emission driver may be implemented on a flexible printed circuit film, a tape carrier package (TCP), a printed circuit board (PCB), or formed on a same substrate as the data driver, scan drivers, control signal generator, timing controller, and/or emission driver. Further, the various components of the data driver, scan drivers, control signal generator, timing controller, and/or emission driver may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device or the functionality of a particular computing device may be distributed across one or more other computing devices without departing from the scope of the exemplary embodiments of the present invention.

It will be understood that, although the terms first, second, third, etc. may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section without departing from the teachings of example embodiments.

Hereinafter, exemplary embodiments of a display device will be described with reference to the accompanying drawings.

FIG. 1A is a diagram illustrating a configuration of a display device 10 according to an embodiment of the present disclosure.

Referring to FIG. 1A, the display device 10 according to an exemplary embodiment may include pixels PXL1 and PXL2 and a display driver.

The display driver may include a first scan driver 211, a second scan driver 212, an emission driver 220, a data driver 230, a demultiplexer 231, a control signal generator 240, and a timing controller 250.

The first pixels PXL1 may be connected to first scan lines S11-S1*n*. The first pixels PXL1 receive data signals from data lines D1-D4 when scan signals are supplied from the first scan lines S11-S1*n*.

As illustrated in FIG. 1A, each of the first pixels PXL1 may be connected to one scan line, but in other embodiments, each of the first pixels PXL1 may be connected to a plurality of scan lines. For example, the first pixel PXL1 positioned in an i-th horizontal line may be connected to an i-th first scan line S1*i* and an (i−1)-th first scan line S1*i*−1. In this embodiment, the display device 10 may further include another first scan line different from the first scan line S11, and the other first scan line may also be connected to the first pixel PXL1 positioned in the first horizontal line.

The data signal supplied to the first pixel PXL1 may control the amount of current flowing from the first power source ELVDD to the second power source ELVSS via an organic light emitting diode. The organic light emitting diode may generate light having a luminance corresponding to the amount of current flowing through the organic light emitting diode.

The first pixels PXL1 may be arranged (e.g., arranged adjacent each other) along a second direction DR2, but the present disclosure is not limited thereto. For example, the first pixels PXL1 may be arranged (e.g., arranged adjacent each other) in a direction oblique to the second direction DR2.

The first pixel PXL1 may include a first sub-pixel SP1, a second sub-pixel SP2, a third sub-pixel SP3, and a fourth sub-pixel SP4.

The second pixels PXL2 may be connected to second scan lines S21-S2*n*. The second pixels PXL2 receive data signals from the data lines D5-D8 when scan signals are supplied from the second scan lines S21-S2*n*.

As illustrated in FIG. 1A, each of the second pixels PXL2 may be connected to one scan line, but in other embodiments, each of the second pixels PXL2 may be connected to a plurality of scan lines. For example, the second pixel PXL2 positioned in the i-th horizontal line may be connected to an i-th second scan line S2*i* and an (i−1)-th second scan line S2*i*−1. In this embodiment, the display device 10 may further include another second scan line different from the second scan line S21, and the other second scan line may be connected to the second pixel PXL2 positioned in the i-th horizontal line.

The data signal supplied to the second pixel PXL2 may control the amount of current flowing from the first power source ELVDD to the second power source ELVSS via an organic light emitting diode. The organic light emitting diode may generate light having a luminance corresponding to the amount of current flowing through the organic light emitting diode.

The second pixels PXL2 may be arranged (e.g., arranged adjacent each other) along the second direction DR2, but the present disclosure is not limited thereto. For example, the second pixels PXL2 may be arranged (e.g., arranged adjacent each other along) in a direction oblique to the second direction DR2.

As shown in FIG. 1A, the first pixel PXL1 and the second pixel PXL2 may be alternately arranged along a first direction DR1.

The second pixel PXL2 may include the first sub-pixel SP1, the second sub-pixel SP2, the third sub-pixel SP3, and the fourth sub-pixel SP4. The first-fourth sub-pixels SP1-SP4 included in each of the first pixel PXL1 and the second pixel PXL2 may be arranged in a matrix.

Each of the first-fourth sub-pixels SP1-SP4 may emit light having any one of red, green, and blue colors. For example, the first sub-pixel SP1 may emit red light, the second sub-pixel SP2 and the fourth sub-pixel SP4 may emit green light, and the third sub-pixel SP3 may emit blue light.

However, the present disclosure is not limited thereto, and the emission colors of the first-fourth sub-pixels SP1-SP4 may be variously changed. For example, each of the first-fourth sub-pixels SP1-SP4 may emit light having colors other than red, green, and blue.

The timing controller 250 may generate scan driving control signals SCS1 and SCS2, a data driving control signal DCS, a demultiplexer switching control signal DMCS, and an emission driving control signal ECS based on signals CS input from the outside.

In addition, the timing controller 250 may convert image data input from the outside into image data DATA suitable for (e.g., suitable for the specifications of) the data driver 230 and may supply the image data DATA to the data driver 230.

A first scan driving control signal SCS1 generated by the timing controller 250 may be supplied to the first scan driver 211, a second scan driving control signal SCS2 generated by the timing controller 250 may be supplied to the second scan driver 212, the data driving control signal DCS generated by the timing controller 250 may be supplied to the data driver 230, the demultiplexer switching control signal DMCS generated by the timing controller 250 may be supplied to the control signal generator 240, and the emission driving control signal ECS generated by the timing controller 250 may be supplied to the emission driver 220.

The first scan driver 211 may supply first scan signals to the first scan lines S11-S1*n* in response to the first scan driving control signal SCS1 generated by the timing controller 250.

For example, the first scan driver 211 may sequentially supply the first scan signals to the first scan lines S11-S1*n* so that the first pixels PXL1 are sequentially selected in units of horizontal lines (e.g., sequentially selected by horizontal lines or columns).

The second scan driver 212 may supply second scan signals to the second scan lines S21-S2*n* in response to the second scan driving control signal SCS2 generated by the timing controller 250.

For example, the second scan driver 212 may sequentially supply the second scan signals to the second scan lines S21-S2*n* so that the second pixels PXL2 are sequentially selected in units of horizontal lines (e.g., sequentially selected by horizontal lines or columns).

The first and second scan signals may be a voltage at which the transistors are turned on (e.g., may be a sufficient voltage such that the transistors are turned on).

The emission driver 220 may supply emission control signals to emission control lines E1-En in response to the emission driving control signal ECS. For example, the emission driver 220 may sequentially supply the emission control signals to the emission control lines E1-En.

The data driver 230 may generate a data signal in response to the data driving control signal DCS. The data driver 230 may include output channels CH1-CHh to output the data signal. The number of output channels CH1-CHh may be less than the number of data lines D1-Dm.

The demultiplexer 231 may distribute the image data input from the data driver 230 and supply the distributed image data to the data lines D1-Dm. The demultiplexer 231 may include a plurality of switches DMS11-DMS42.

Each of the plurality of switches DMS11-DMS42 may be connected between one of the output channels CH1-CHh and one of the data lines D1-Dm. In addition, each of the plurality of switches DMS11-DMS42 may be turned on according to a control signal supplied from the control signal generator 240.

As illustrated in FIG. 1A, two switches may be connected to one output channel, but the present disclosure is not limited thereto. For example, the number of switches connected to one output channel may be variously, suitably changed.

The data signal supplied to the data lines D1-Dm may be supplied to the first pixel PXL1 selected by the first scan signal or the second pixel PXL2 selected by the second scan signal.

As illustrated in FIG. 1A, the first scan driver 211, the second scan driver 212, the emission driver 220, the data driver 230, the control signal generator 240, and the timing controller 250 may be separate components from each other but, in some embodiments, at least some of these components may be integrated with each other.

In addition, the first scan driver 211, the second scan driver 212, the emission driver 220, the data driver 230, the control signal generator 240, and the timing controller 250 may be formed by various suitable methods, such as chip on glass, chip on plastic, tape carrier package, chip on film, etc.

Figure 1B:
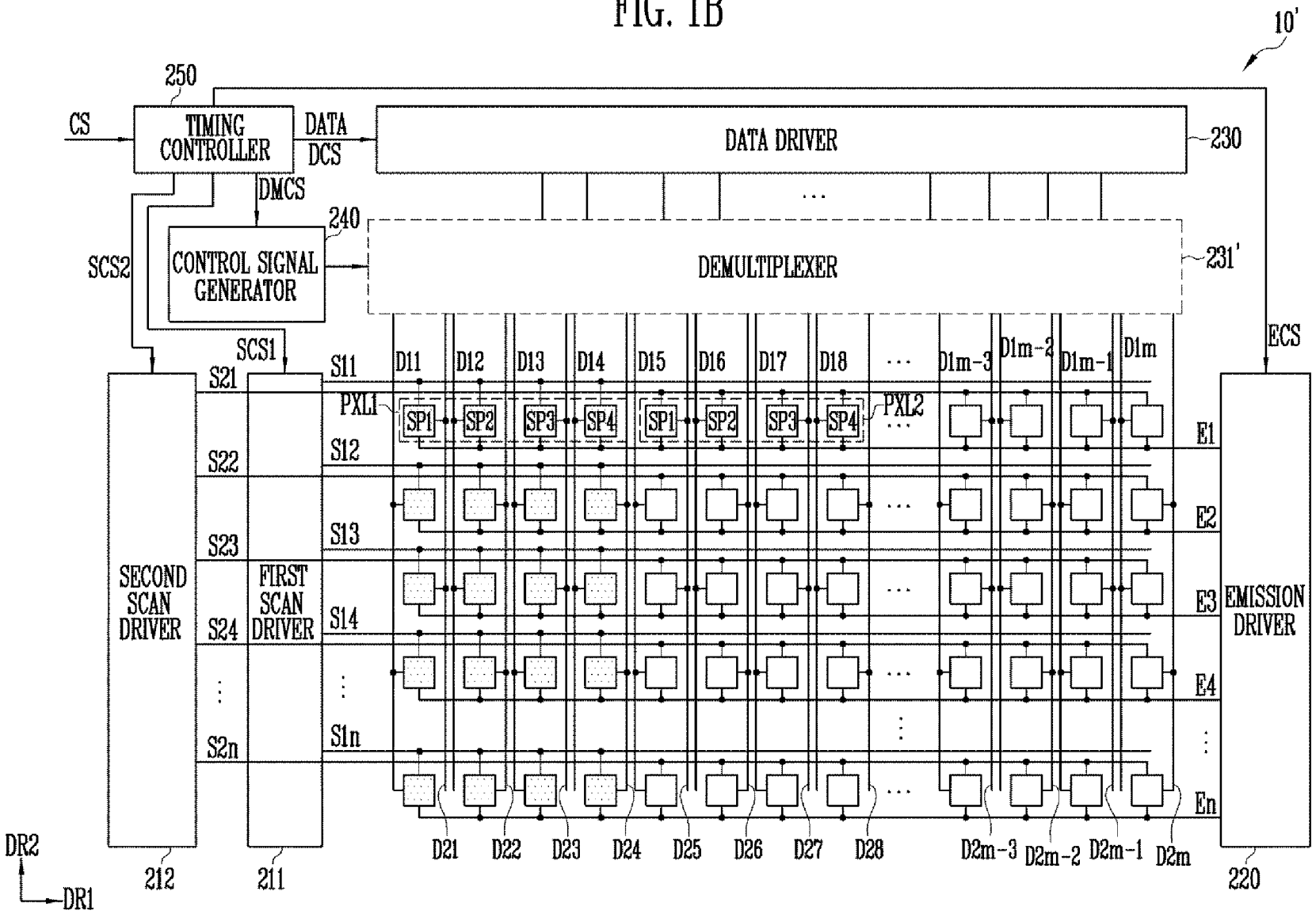
FIG. 1B is a diagram illustrating a configuration of a display device according to another embodiment of the present disclosure.

FIG. 1B is a diagram illustrating a configuration of a display device according to another embodiment of the present disclosure. In FIG. 1B, components, arrangements, and/or configurations different from those described above with respect to the embodiment shown in FIG. 1A will be primarily described, and descriptions of components, arrangements, and/or configurations overlapping with (e.g., the same or substantially the same as) those of the described above with respect to the embodiment shown in FIG. 1A may be omitted. Accordingly, hereinafter, first data lines and second data lines will be primarily described.

Referring to FIG. 1B, the data driver 230 may supply data signals to a demultiplexer 231'.

The demultiplexer 231' may be connected to first data lines D11-D1*m* and second data lines D21-D2*m*. The demultiplexer 231' may include a 1×4 demultiplexer.

The pixels PXL1 and PXL2 may be connected to the first data lines D11-D1*m* or the second data lines D21-D2*m*.

For example, one of the first data lines D11-D1*m* and one of the second data lines D21-D2*m* may be provided at both sides of the pixels PXL1 and PXL2 arranged along a vertical line (e.g., along a line in the second direction DR2).

When the first data lines D11-D1*m* are connected to the pixels PXL1 and PXL2 located in an odd numbered horizontal line from among the pixels PXL1 and PXL2 arranged along the vertical line (e.g., along the line in the second direction DR2), the second data lines D21-D2*m* may be connected to the pixels PXL1 and PXL2 located in an even numbered horizontal line from among the pixels PXL1 and PXL2 arranged along the vertical line (e.g., along a line in the second direction DR2).

However, the connection structure between the pixels PXL1 and PXL2 and the data lines D11-D1*m* and D21-D2*m* is not limited to the connection structure shown in FIG. 1B. For example, the connection structure between the pixels PXL1 and PXL2 and the data lines D11-D1*m* and D21-D2*m* may be variously, suitably changed.

Figure 2:
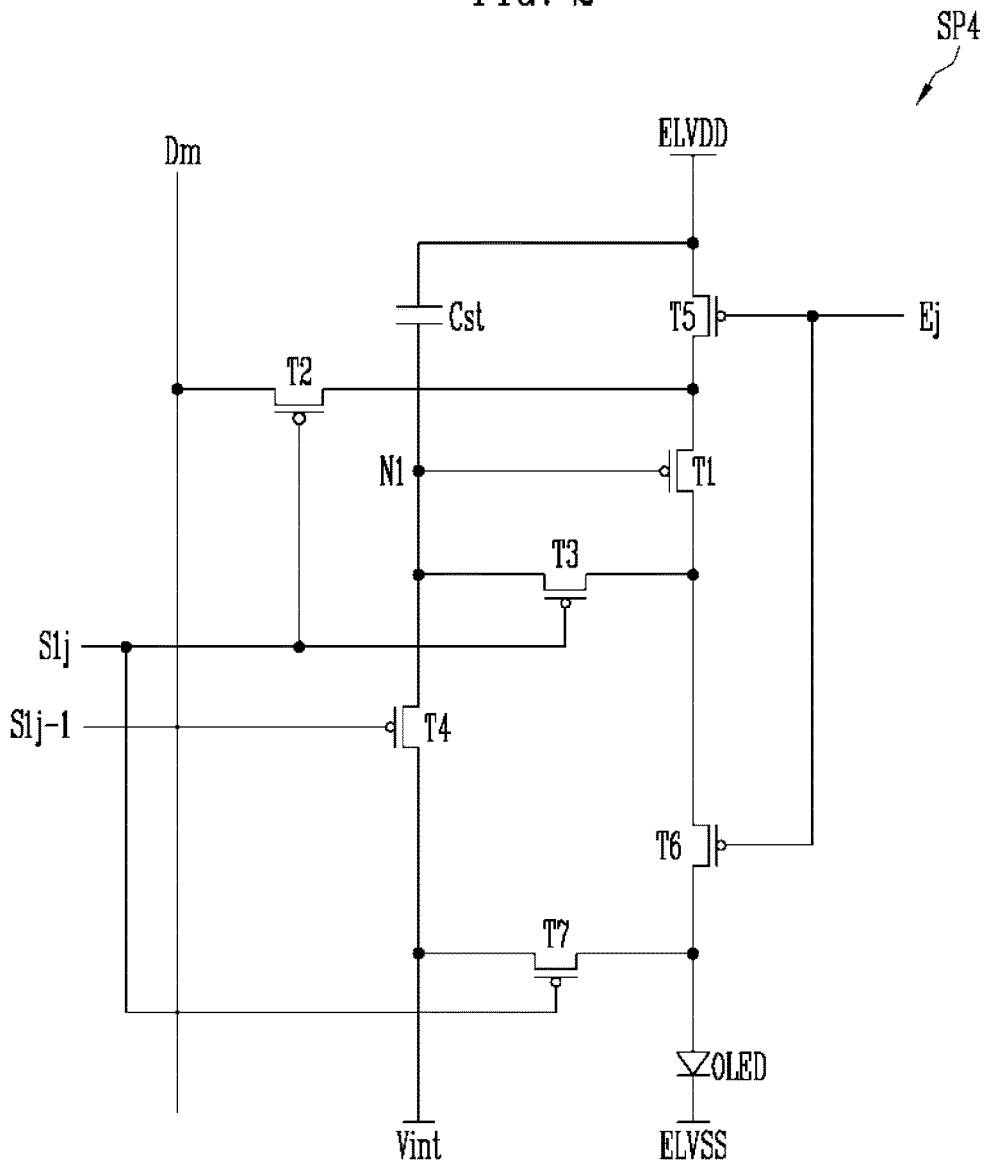
FIG. 2 is a diagram illustrating an embodiment of a sub-pixel shown in FIG. 1A.

FIG. 2 is a diagram illustrating an embodiment of a sub-pixel shown in FIG. 1A.

For convenience of explanation, the fourth sub-pixel SP4 connected to a jth first scan line S1*j* and an mth data line Dm is illustrated in FIG. 2.

Referring to FIG. 2, according to an embodiment, the fourth sub-pixel SP4 according to an exemplary embodiment may include an organic light emitting diode OLED, first-seventh transistors T1-T7, and a storage capacitor Cst.

An anode of the organic light emitting diode OLED may be connected to the first transistor T1 via a sixth transistor T6, and a cathode of the organic light emitting diode OLED may be connected to the second power supply ELVSS. The organic light emitting diode OLED may generate light having a brightness (e.g., a predetermined brightness) in response to (according to) the amount of current supplied from the first transistor T1.

The first power supply ELVDD may be a higher voltage than the second power supply ELVSS so that current may flow through the organic light emitting diode OLED.

The seventh transistor T7 may be connected between an initialization power supply voltage Vint and the anode of the organic light emitting diode OLED. In addition, a gate electrode of the seventh transistor T7 may be connected to the jth first scan line S1*j*. The seventh transistor T7 may be turned on when a scan signal is supplied to the jth first scan line S1*j* and may supply the initialization power supply voltage Vint to the anode of the organic light emitting diode OLED. The initialization power supply voltage Vint may be a lower voltage than the data signal.

The sixth transistor T6 may be connected between the first transistor T1 and the organic light emitting diode OLED. A gate electrode of the sixth transistor T6 may be connected to a jth emission line Ej. The sixth transistor T6 may be turned off when an emission control signal is supplied to the jth emission line Ej and may otherwise be turned on (e.g., may otherwise be in an on state).

A fifth transistor T5 may be connected between the first power supply ELVDD and the first transistor T1. In addition, a gate electrode of the fifth transistor T5 may be connected to the jth emission line Ej. The fifth transistor T5 may be turned off when the emission control signal is supplied to the jth emission line Ej and may otherwise be turned on (e.g., may otherwise be in an on state).

A first electrode of the first transistor T1 (e.g., a driving transistor) may be connected to the first power supply ELVDD via the fifth transistor T5, and a second electrode of the first transistor T1 may be connected to the anode of the organic light emitting diode OLED via the sixth transistor T6. A gate electrode of the first transistor T1 may be connected to a first node N1. The first transistor T1 may control the amount of current flowing from the first power supply ELVDD through the organic light emitting diode OLED to the second power supply ELVSS in response to (according to) a voltage at the first node N1.

A third transistor T3 may be connected to the second electrode of the first transistor T1 and the first node N1. A gate electrode of the third transistor T3 may be connected to the jth first scan line S1*j*. The third transistor T3 may be turned on when the scan signal is supplied to the jth first scan line S1*j* and may electrically connect the second electrode of the first transistor T1 and the first node N1. Therefore, when the third transistor T3 is turned on, the first transistor T1 may be connected in a diode form (i.e., diode-connected).

The fourth transistor T4 may be connected between the first node N1 and the initialization power supply voltage Vint. In addition, a gate electrode of the fourth transistor T4 may be connected to a (j−1)th first scan line S1*j*−1. The fourth transistor T4 may be turned on when a scan signal is supplied to the (j−1)th first scan line S1*j*−1 and may supply the initialization power supply voltage Vint to the first node N1.

A second transistor T2 may be connected between the mth data line Dm and the first electrode of the first transistor T1. In addition, a gate electrode of the second transistor T2 may be connected to the jth first scan line S1*j*. The second transistor T2 may be turned on when the scan signal is supplied to the jth first scan line S1*j* and may electrically connect the mth data line Dm to the first electrode of the first transistor T1.

The storage capacitor Cst may be connected between the first power supply ELVDD and the first node N1. The storage capacitor Cst may store a voltage corresponding to the data signal and a threshold voltage of the first transistor T1.

The pixel structure shown in FIG. 2 is an example embodiment of the present disclosure, and therefore, the fourth sub-pixel SP4 is not limited thereto. The fourth sub-pixel SP4 may have one of various, suitable circuit configurations currently known in the art so that the fourth sub-pixel SP4 may supply current to the organic light emitting diode OLED.

The first power supply ELVDD may be a high-potential power supply, and the second power supply ELVSS may be a low-potential power supply.

For example, the first power supply ELVDD may be a positive voltage, and the second power supply ELVSS may be a negative voltage or a ground voltage.

Each of the first-third sub-pixel SP1-SP3 may have (e.g., may be composed of) the same or substantially the same circuit configuration as the above-described fourth sub-pixel SP4. Therefore, a detailed description of the first-third sub-pixels SP1-SP3 may be omitted.

Figure 3:
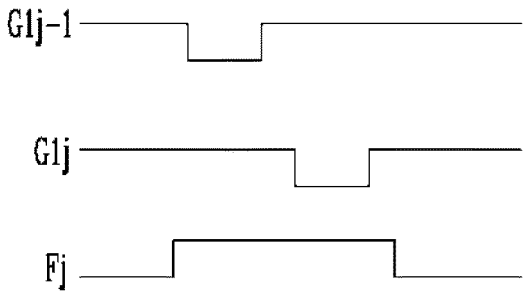
FIG. 3 is a diagram illustrating a method of driving the sub-pixel shown in FIG. 2.

FIG. 3 is a diagram illustrating a method of driving the sub-pixel (e.g., the fourth sub-pixel SP4) shown in FIG. 2.

Referring to FIG. 3, a jth emission signal Fj may be supplied to the jth emission line Ej. When the jth emission signal Fj is supplied to the jth emission line Ej, the fifth transistor T5 and the sixth transistor T6 may be turned off. Thus, the fourth sub-pixel SP4 may be set to a non-emission state.

Subsequently, a (j−1)th first scan signal G1j−1 may be supplied to the (j−1)th first scan line S1j−1 to turn on the fourth transistor T4. When the fourth transistor T4 is turned on, the initialization power supply voltage Vint may be supplied to the first node N1. Thus, the first node N1 may be initialized to the initialization power supply voltage Vint.

After the first node N1 is initialized to the initialization power supply voltage Vint, a jth first scan signal G1j may be supplied to the jth first scan line S1j. When the jth first scan signal G1j is supplied to the jth first scan line S1j, the second transistor T2, the third transistor T3, and the seventh transistor T7 may be turned on.

When the seventh transistor T7 is turned on, the initialization power supply voltage Vint may be supplied to the anode electrode of the organic light emitting diode OLED. Thus, a parasitic capacitor formed by the organic light emitting diode OLED may be discharged so that black expression (e.g., black display) capability may be improved.

For example, the parasitic capacitor of the organic light emitting diode OLED may be charged with a voltage (e.g., a predetermined voltage) in response to (according to) current supplied during a previous frame. When a black gray level is to be displayed during the current frame, the organic light emitting diode OLED may maintain the non-emission state. However, when the parasitic capacitor of the organic light emitting diode OLED remains charged, the organic light emitting diode OLED may slightly emit light (e.g., may emit some light) due to a leakage current of the first transistor T1.

When the parasitic capacitor of the organic light emitting diode OLED is discharged, the leakage current of the first transistor T1 may precharge the parasitic capacitor of the organic light emitting diode OLED and the organic light emitting diode OLED may maintain the non-emission state.

When the third transistor T3 is turned on, the first transistor T1 may be connected in a diode form (i.e., diode-connected).

When the second transistor T2 is turned on, the data signal from the data line Dm may be supplied to the first electrode of the first transistor T1. Because the first node N1 is initialized to the initialization power supply voltage Vint, which is lower than the data signal, the first transistor T1 may be turned on. When the first transistor T1 is turned on, a voltage obtained by subtracting the threshold voltage of the first transistor T1 from the data signal may be supplied to the first node N1. The storage capacitor Cst may store a voltage corresponding to the data signal applied to the first node N1 and the threshold voltage of the first transistor T1.

After the voltage corresponding to the data signal applied to the first node N1 and the threshold voltage of the first transistor T1 is stored in the storage capacitor Cst, supply of the jth emission signal Fj to the jth emission line Ej may be stopped.

When the supply of the jth emission signal Fj to the jth emission line Ej is stopped, the fifth transistor T5 and the sixth transistor T6 may be turned on. As a result, a current path may be formed from the first power supply ELVDD to the second power supply ELVSS through the fifth transistor T5, the first transistor T1, the sixth transistor T6, and the organic light emitting diode OLED.

The first transistor T1 may control the amount of current flowing from the first power supply ELVDD through the organic light emitting diode OLED to the second power supply ELVSS in response to (according to) the voltage of the first node N1. The organic light emitting diode OLED may generate light having a brightness (e.g., a predetermined brightness) in response to (according to) the amount of current supplied from the first transistor T1.

The jth emission signal Fj supplied to the jth emission line Ej may be supplied to overlap with (e.g., may be supplied concurrently with) at least one scan signal so that the fourth sub-pixel SP4 may be set to a non-emission state when the data signal is charged to the fourth sub-pixel SP4. The timing at which the emission signal is supplied may be set by various, suitable methods currently known in the art.

Figure 4:
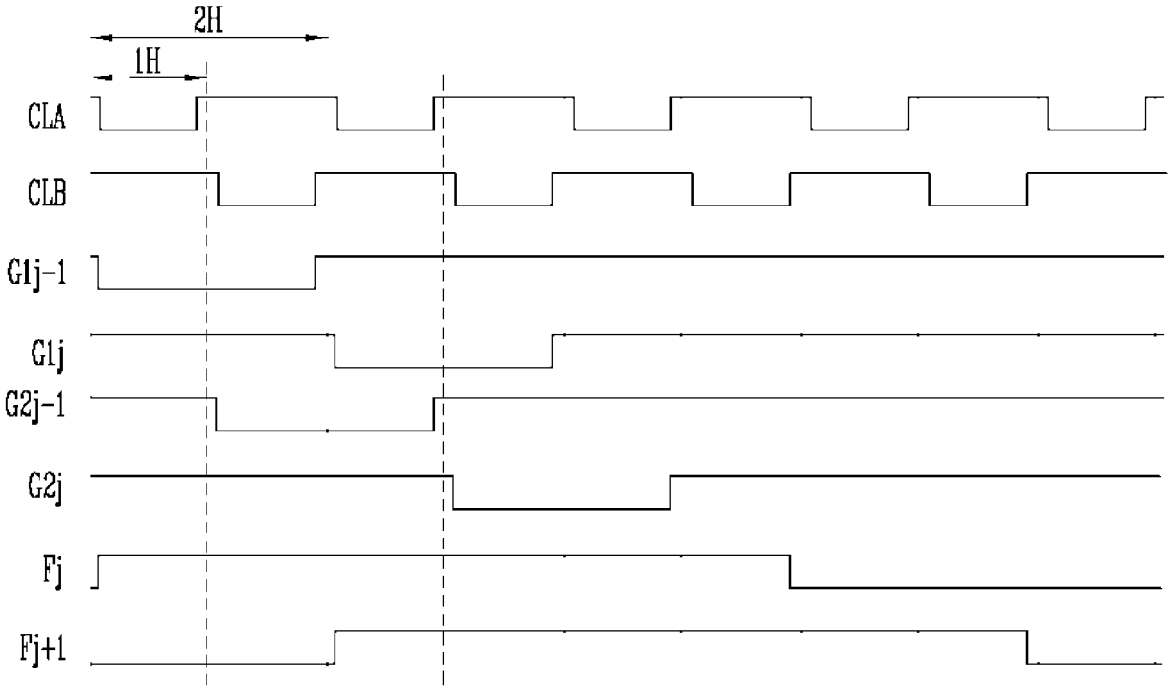
FIG. 4 is a waveform illustrating output signals from a control signal generator, a scan driver, and an emission driver shown in FIG. 1A.

FIG. 4 is a waveform view illustrating output signals from the control signal generator 240, the first and second scan drivers 211 and 212, and the emission driver 220 shown in FIG. 1A.

For convenience of explanation, only some of a plurality of scan signals and some of a plurality of emission control signals are illustrated in FIG. 4.

Referring to FIG. 4, a first control signal CLA may have a cycle of (e.g., a cycle lasting) two horizontal periods 2H and may be repeatedly supplied (e.g., the first control signal CLA may be a clock signal). A data signal may be supplied to the first pixel PXL1 when the first control signal CLA is supplied.

A second control signal CLB may be shifted by one horizontal period 1H with respect to the first control signal CLA. The first control signal CLA and the second control signal CLB may supplied so as not to overlap or substantially overlap with each other. A data signal may be supplied to the second pixel PXL2 when the second control signal CLB is supplied.

The first scan signals may be sequentially supplied so as not to overlap or substantially overlap each other. As shown in FIG. 4, after the (j−1)th first scan signal G1j−1 is supplied, the jth first scan signal G1j may be supplied, and each of the first scan signals may be supplied during about two horizontal periods 2H.

The second scan signals may be sequentially supplied so as not to overlap or substantially overlap each other. As shown in FIG. 4, after a (j−1)th second scan signal G2j−1 is supplied, a jth second scan signal G2j may be supplied, and each of the second scan signals may be supplied during about two horizontal periods 2H.

The second scan signals may be shifted by one horizontal period 1H with respect to the first scan signals. For example, as shown in FIG. 4, the jth second scan signal G2j may be supplied one horizontal period 1H after the jth first scan signal G1j is supplied. Thus, the jth first scan signal G1j may overlap with the jth second scan signal G2j during a period (e.g., during a predetermined period).

If the second pixel PXL2, which is supplied with the data signal when the second control signal CLB is supplied, is connected to the first scan line and is supplied with the first scan signal in the same or substantially the same manner as the first pixel PXL1, a period of time to initialize the first node N1 of the second pixel PXL2 and the anode electrode of the organic light emitting diode OLED and a period of time to compensate the threshold voltage of the first transistor T1 to the first node N1 may not be sufficiently ensured.

However, in the display device 10 according to an embodiment of the present disclosure, because a separate second scan line connected to the second pixel PXL2 is provided and the second scan signal is supplied to the second pixel PXL2 through the separate second scan line, a sufficient amount of time to compensate the threshold voltage of the first transistor T1 to the first node N1 may be ensured.

Figure 5:
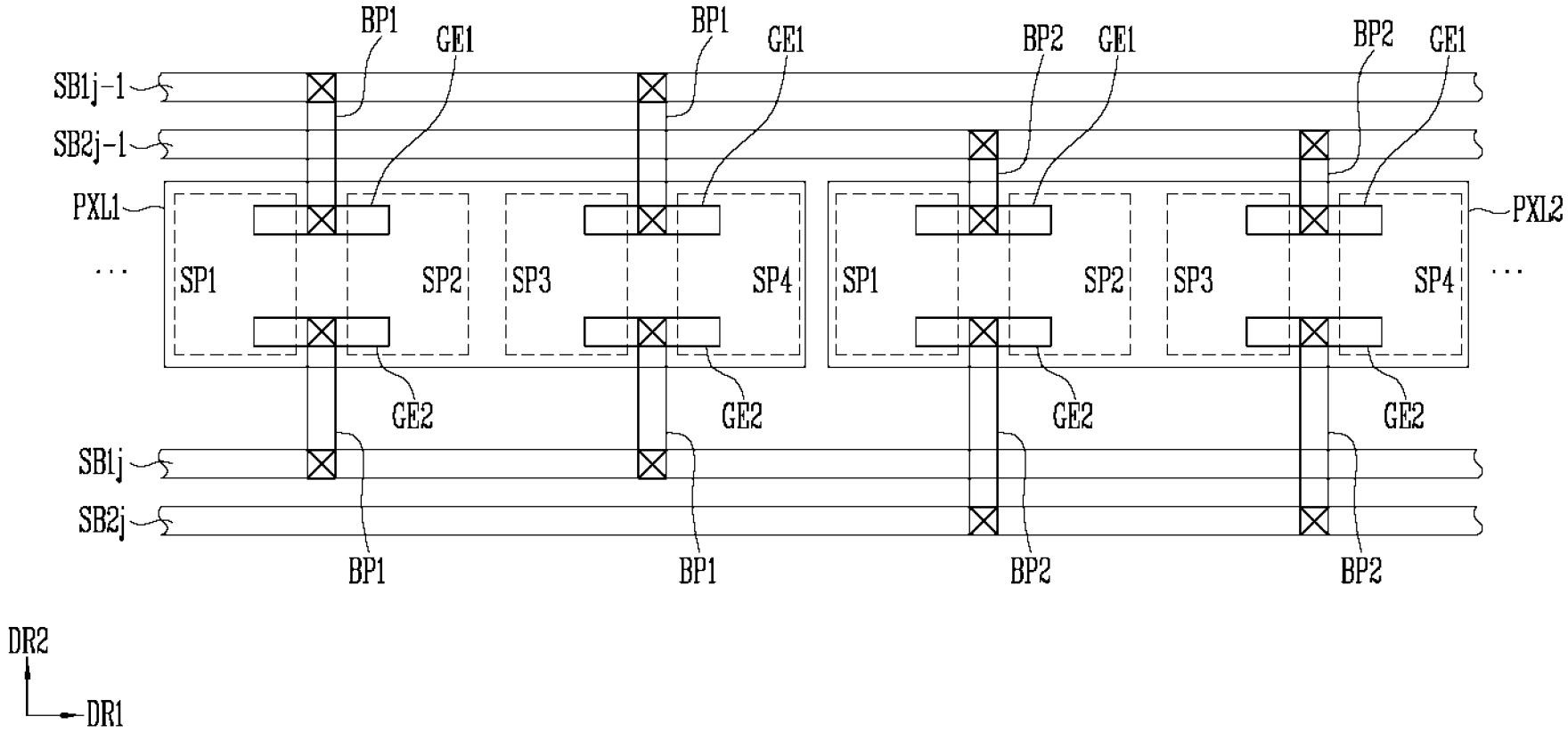
FIGS. 5-7 are plan views illustrating bus wires according to embodiments of the present disclosure.
Figure 6:
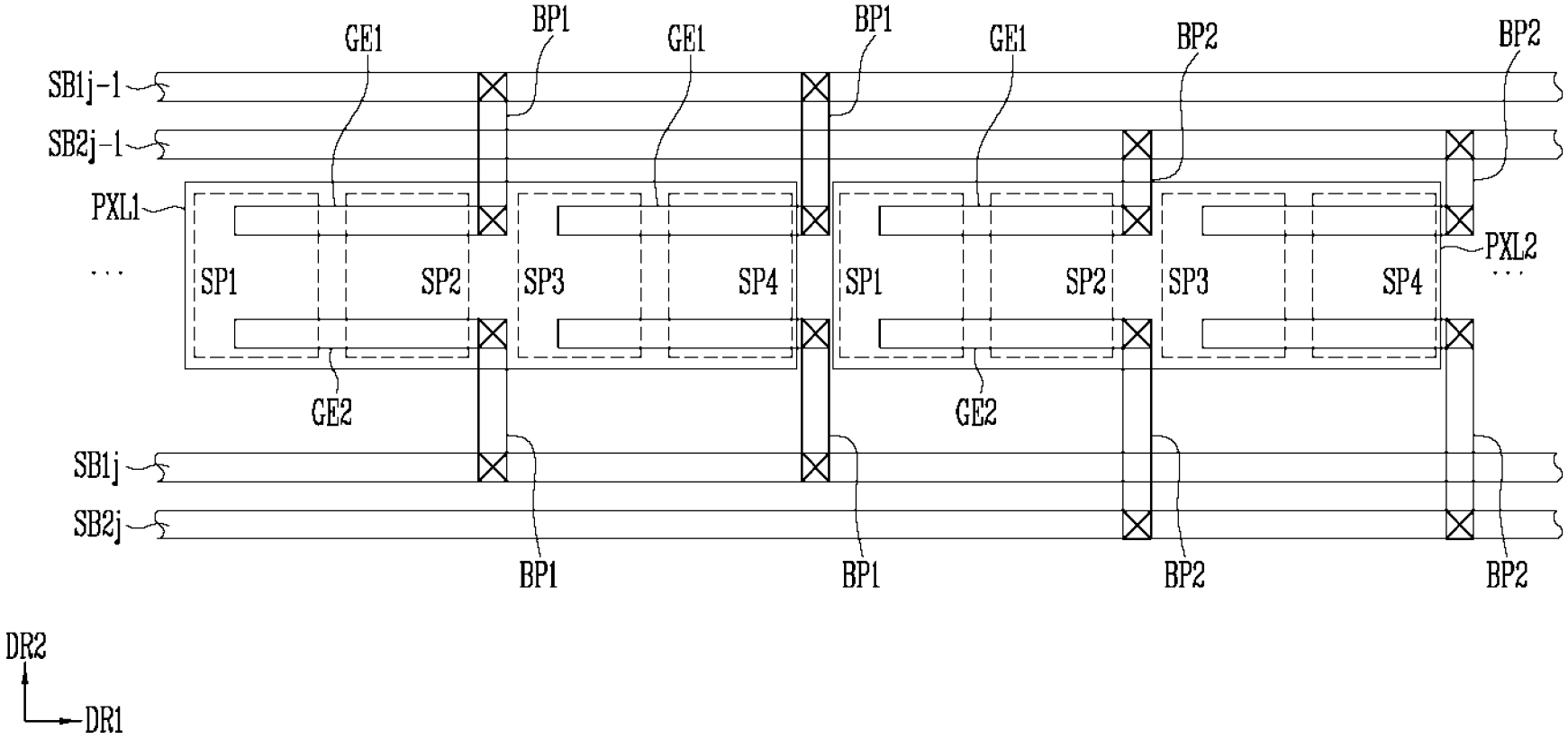
Figure 7:
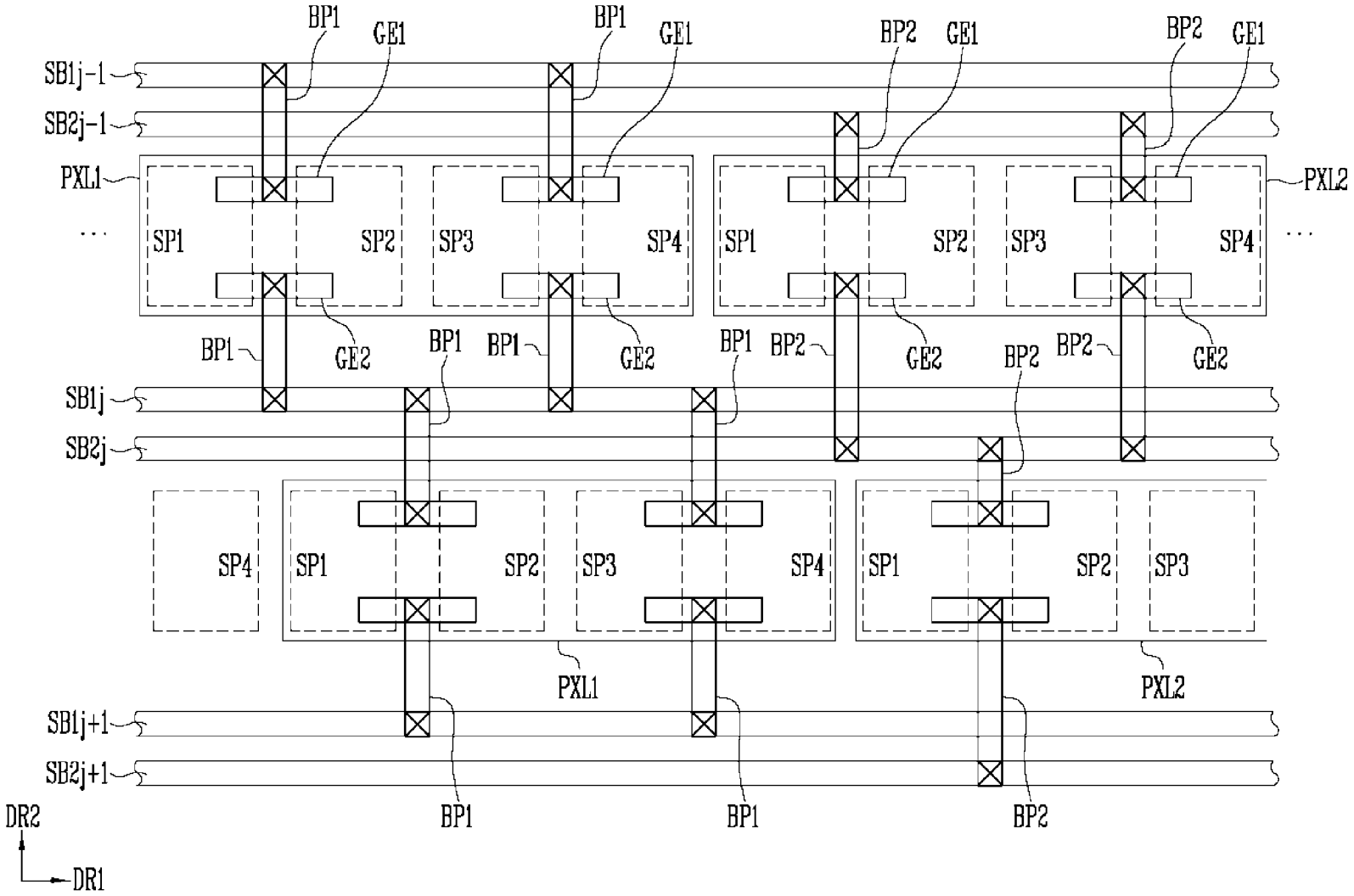

FIGS. 5-7 are plan views illustrating bus wires according to embodiments of the present disclosure.

For convenience of explanation, (j−1)th bus wires SB1$j$−1 and SB2$j$−1, jth bus wires SB1$j$ and SB2$j$, and ones of the first pixels PXL1 and the second pixels PXL2 located between the (j−1)th bus wires SB1$j$−1 and SB2$j$−1 and the jth bus wires SB1$j$ and SB2$j$ are illustrated in FIGS. 5-7.

Each of the first scan lines S11-S1$n$ described above may include a first bus wire and a plurality of bridge patterns. For example, the jth first scan line S1$j$ may include a jth first bus wire SB1$j$ and first bridge patterns BP1 electrically connected to the jth first bus wire SB1$j$.

In addition, each of the second scan lines S21-S2$n$ may include a second bus wire and a plurality of bridge patterns. For example, the jth second scan line S2$j$ may include a jth second bus wire SB2$j$ and second bridge patterns BP2 electrically connected to the jth second bus wire SB2$j$.

Each of the first bus wires SB1$j$−1 and SB1$j$ may be formed to extend along the first direction DR1. In addition, the first bus wires SB1$j$−1 and SB1$j$ may be arranged along (e.g., arranged adjacent each other along) the second direction DR2.

The (j−1)th first scan signal and the jth first scan signal may be supplied to a (j−1)th first bus wire SB1$j$−1 and the jth first bus wire SB1$j$, respectively. The first scan signals supplied to the first bus wires SB1$j$−1 and SB1$j$ may be supplied to the first pixel PXL1 adjacent to the first bus wires SB1$j$−1 and SB1$j$.

Each of the second bus wires SB2$j$−1 and SB2$j$ may be formed to extend along the first direction DR1. In addition, the second bus wires SB2$j$−1 and SB2$j$ may be arranged along (e.g., arranged adjacent each other along) the second direction DR2.

The (j−1)th second scan signal and the jth second scan signal may be supplied to a (j−1)th second bus wire SB2$j$−1 and the jth first bus wire SB2$j$, respectively. The second scan signals supplied to the second bus wires SB2$j$−1 and SB2$j$ may be supplied to the second pixel PXL2 adjacent to the second bus wires SB2$j$−1 and SB2$j$.

One of the first bus wires and one of the second bus wires may be located between two adjacent pixel columns (e.g., pixel columns extending in the first direction DR1) and may be parallel to each other.

The first bridge patterns BP1 may be respectively connected to the first bus wires SB1$j$−1 and SB1$j$. The first bridge patterns BP1 may be located between two adjacent sub-pixels. For example, the first bridge patterns BP1 may be located between the first sub-pixel SP1 and the second sub-pixel SP2, and between the third sub-pixel SP3 and the fourth sub-pixel SP4 as shown in FIG. 5.

The first bridge pattern BP1 may be electrically connected to a gate electrode pattern GE1 corresponding to a gate electrode of the fourth transistor T4 of the first and second sub-pixels SP1 and SP2 and/or of the third and fourth sub-pixels SP3 and SP4. In addition, the first bridge pattern BP1 may be electrically connected to gate electrode patterns GE2 corresponding to gate electrodes of the second, third, and seventh transistors T2, T3, and T7 of the first and second sub-pixels SP1 and SP2 and/or of the third and fourth sub-pixels SP3 and SP4.

The first bridge patterns BP1 may be connected at a center portion of the gate electrode patterns GE1 and GE2 that extends between (e.g., are commonly included in) two adjacent sub-pixels.

The first pixel PXL1 located on the jth pixel column may receive the (j−1)th first scan signal supplied to the (j−1)th first bus wire SB1$j$−1 and the jth first scan signal supplied to the jth first bus wire SB1$j$.

The second bridge patterns BP2 may be respectively connected to the second bus wires SB2$j$−1 and SB2$j$. The second bridge patterns BP2 may be located between two adjacent sub-pixels. For example, the second bridge patterns BP2 may be located between the first sub-pixel SP1 and the second sub-pixel SP2 and between the third sub-pixel SP3 and the fourth sub-pixel SP4 as shown in FIG. 5.

The second bridge pattern BP2 may be electrically connected to the gate electrode pattern GE1 corresponding to the gate electrode of the fourth transistor T4 of the first and second sub-pixels SP1 and SP2 and/or of the third and fourth sub-pixels SP3 and SP4. In addition, the second bridge pattern BP2 may be electrically connected to the gate electrode patterns GE2 corresponding to the gate electrodes of the second, third, and seventh transistors T2, T3 and T7 of the first and second sub-pixels SP1 and SP2 and/or of the third and fourth sub-pixels SP3 and SP4.

The second bridge patterns BP2 may be connected at a center portion of the gate electrode patterns GE1 and GE2 that extend between (e.g., are commonly included in) two adjacent sub-pixels.

The second pixel PXL2 located on the jth pixel column may receive the (j−1)th second scan signal supplied to the (j−1)th second bus wire SB2$j$−1 and the jth second scan signal supplied to the jth second bus wire SB2$j$.

As shown in FIG. 6, according to another embodiment of the present disclosure, the first bridge patterns BP1 may be respectively connected to the first bus wires SB1$j$−1 and SB1$j$. The first bridge patterns BP1 may be located between two adjacent sub-pixels.

The first bridge patterns BP1 may be connected to end portions of the gate electrode patterns GE1 and GE2 that extend between (e.g., are commonly included in) two adjacent sub-pixels.

The second bridge patterns BP2 may be respectively connected to the second bus wires SB2$j$−1 and SB2$j$. The second bridge patterns BP2 may be located between two adjacent sub-pixels.

The second bridge patterns BP2 may be connected to end portions of the gate electrode patterns GE1 and GE2 that extend between (e.g., are commonly included in) two adjacent sub-pixels.

As shown in FIG. 7, according to another embodiment of the present disclosure, different from the arrangement of the bridge patterns BP1 and BP2 along the vertical line as shown in FIGS. 5 and 6, the first bridge patterns BP1 and the second bridge patterns BP2 may be arranged in a zigzag shape.

As shown in FIGS. 5-7, both the first scan lines and the second scan lines may be used in a high-resolution display device by using the bus wires and the bridge patterns.

According to embodiments of the present disclosure, a display device having improved display quality may be provided.

Example embodiments have been disclosed herein, and although specific terms are employed, they are used and are to be interpreted in a generic and descriptive sense and not for purpose of limitation. In some instances, as would be apparent to one of ordinary skill in the art, aspects, features, and/or elements described in connection with a particular embodiment may be used singly or in combination with aspects, features, and/or elements described in connection with other embodiments unless otherwise specifically indicated. Accordingly, it will be understood by those of skill in the art that various changes in form and details may be made without departing from the spirit and scope of the present disclosure as set forth in the following claims and their equivalents.

What is claimed is:

1. A display device comprising:

a plurality of pixel rows extending along a first direction, each of the pixel rows comprising a plurality of first and second pixels, each of the first pixels and each of the second pixels comprising a plurality of sub-pixels;

a plurality of first bus wires extending along the first direction, a first one of the first bus wires being at one side of a first pixel row from among the pixel rows, a second one of the first bus wires being at an opposite side of the first pixel row from among the pixel rows, the first pixels arranged in the first pixel row being connected to both the first one and the second one of the first bus wires, the first bus wires being connected to the first pixels by a plurality of first bridge patterns; and a plurality of second bus wires extending along the first direction, a first one of the second bus wires being at the one side of the first pixel row from among the pixel rows, a second one of the second bus wires being at the opposite side of the first pixel row from among the pixel rows, the second pixels arranged in the first pixel row being connected to both the first one of the second bus wires and the second one of the second bus wires, wherein adjacent ones of the sub-pixels of the each of the first pixels are connected to one of the first bridge patterns.

2. The display device of claim 1, wherein the first bus wires are configured to supply first scan signals to the first pixels, and the second bus wires are configured to supply second scan signals to the second pixels.

3. The display device of claim 2, wherein the first scan signals overlap with the second scan signals during a period.

4. The display device of claim 2, further comprising a plurality of second bridge patterns connected to the second bus wires.

5. The display device of claim 4, wherein the adjacent ones of the sub-pixels in each of the first pixels are configured to receive the first scan signals through the one of the first bridge patterns.

6. The display device of claim 4, wherein adjacent ones of the sub-pixels in each of the second pixels are configured to receive the second scan signals through one of the second bridge patterns.

7. The display device of claim 4, wherein each of the first bridge patterns and each of the second bridge patterns are located between adjacent ones of the sub-pixels.

8. The display device of claim 4, wherein the first pixels are configured to receive the first scan signals through the first bridge patterns, and wherein the second pixels are configured to receive the second scan signals through the second bridge patterns.

9. The display device of claim 4, wherein a jth first bus wire from among the first bus wires and a jth second bus wire from among the second bus wires are between a jth pixel row and a (j+1)th pixel row from among the pixel rows, and wherein j is a natural number greater than or equal to 2.

10. The display device of claim 9, wherein the jth first bus wire is between the jth second bus wire and the jth pixel row.

11. The display device of claim 9, wherein the first pixels in the jth pixel row are connected to a first bridge pattern connected to a (j−1)th first bus wire from among the first bus wires and to a first bridge pattern connected to the jth first bus wire.

12. The display device of claim 9, wherein the second pixels in the jth pixel row are connected to a second bridge pattern connected to a (j−1)th second bus wire from among the second bus wires and a second bridge pattern connected to the jth second bus wire.

13. The display device of claim 1, wherein the first pixels and the second pixels are alternately arranged in one of the pixel rows.

14. The display device of claim 1, wherein the pixel rows are adjacent to each other along a second direction.

15. The display device of claim 1, wherein the second bus wires are connected to the second pixels by a plurality of second bridge patterns, and wherein adjacent ones of the sub-pixels of each of the second pixels are connected to one of the second bridge patterns.

* * * * *